US006312116B2

(12) United States Patent
Underwood et al.

(10) Patent No.: US 6,312,116 B2
(45) **Date of Patent: *Nov. 6, 2001**

(54) INK CARTRIDGE HAVING AN INTEGRAL PRESSURIZATION APPARATUS

(75) Inventors: John A. Underwood, Vancouver, WA (US); John Barinaga, Portland, OR (US); Bruce Cowger; Norman E. Pawlowski, Jr., both of Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/069,657

(22) Filed: Apr. 29, 1998

Related U.S. Application Data

(63) Continuation-in-part of application No. 08/429,915, filed on Apr. 27, 1995, now Pat. No. 5,825,387, which is a continuation-in-part of application No. 08/566,833, filed on Dec. 4, 1995, now Pat. No. 5,856,839.

(51) Int. Cl.[7] ..... B41J 2/175
(52) U.S. Cl. ..... 347/86
(58) Field of Search ..... 347/85, 86, 87, 347/89

(56) References Cited

U.S. PATENT DOCUMENTS

| | | | | |
|---|---|---|---|---|
| 3,805,276 | | 4/1974 | Ishii | 347/85 |
| 3,950,761 | | 4/1976 | Kashio | 347/85 |
| 4,053,901 | | 10/1977 | Skafvenstedt et al. | 347/85 |
| 4,187,511 | | 2/1980 | Robinson | 347/7 |
| 4,303,929 | * | 12/1981 | Blanck | 347/86 |
| 4,383,263 | | 5/1983 | Ozawa et al. | 347/30 |
| 4,475,116 | | 10/1984 | Sicking et al. | 347/86 |
| 4,623,905 | | 11/1986 | Ichihashi et al. | 347/86 |
| 5,396,316 | | 3/1995 | Smith | 399/120 |
| 5,400,573 | | 3/1995 | Crystal et al. | 53/468 |
| 5,406,320 | | 4/1995 | Durst et al. | 347/86 |
| 5,485,187 | * | 1/1996 | Okamura et al. | 347/85 |
| 5,552,815 | | 9/1996 | Shimoda | 347/85 |
| 5,825,387 | * | 10/1998 | Cowger et al. | 347/86 |

* cited by examiner

*Primary Examiner*—N. Le
*Assistant Examiner*—Michael Nghiem
(74) *Attorney, Agent, or Firm*—Kevin B. Sullivan

(57) ABSTRACT

One aspect of the present invention is a replaceable ink supply cartridge for providing a pressurized supply of ink to an ink-jet printhead of an ink-jet printer. The replaceable ink supply cartridge includes an activation portion for receiving a linear actuator associated with the ink-jet printer. The linear actuator has an activated state and an inactivated state. In the activated state the linear actuator is biased toward an extended position into engagement with the activation portion. In the inactivated state the linear actuator is in a retracted position. The ink supply cartridge portion provides a source of pressurized ink in response to the activated state of the linear actuator. Wherein in response to the inactivated state of the linear actuator the source of pressurized ink is non-pressurized.

18 Claims, 10 Drawing Sheets

SECTION A–A′

SECTION A–A′

SECTION B–B′

INK CARTRIDGE HAVING AN INTEGRAL PRESSURIZATION APPARATUS

CROSS-REFERENCE TO RELATED APPLICATIONS

This application is a continuation in part of Patent Application entitled "Ink Supply for an Ink-Jet Printer" filed on Apr. 27, 1995 as Ser. No. 08/429,915 now U.S. Pat. No. 5,825,387 and Patent Application entitled "Ink Supply for an Ink-Jet Printer" filed on Dec. 4, 1995 as Ser. No. 08/566,833 now U.S. Pat. No. 5,856,839, both of which are assigned to the assignee of the present invention and incorporated herein by reference.

BACKGROUND OF THE INVENTION

The present invention relates to an ink cartridge for providing a supply of pressurized ink to an ink-jet printer. More particularly, the present invention relates to a method and apparatus for providing a pressurized supply of ink in response to actuation by a linear actuator.

The use of an ink supply that is separately replaceable from the printhead is disclosed in patent application Ser. No. 08/429,915, entitled "Ink Supply For An Ink-Jet Printer" now U.S. Pat. No. 5,825,387 assigned to the assignee of the present invention. The advantage of this type of ink supply is that it allows the user to replace the ink container without replacing the printhead. The printhead can then be replaced at or near the end of printhead life and not when the ink container is exhausted.

Ser. No. 08/429,915 now U.S. Pat. No. 5,825,387 discloses the use of an ink container that includes a diaphragm pump. The diaphragm pump is actuated by an actuator associated with the ink-jet printer for supplying ink from the ink container to the printhead. The use of a pump associated with the ink container ensures a reliable supply of ink to the ink-jet printhead. An interruption in ink flow to the printhead can result in a reduction in print quality or damage to the printhead. This interruption in the flow of ink to the printhead during operation of the printhead can result in printhead deprime which can result in excessive heating of the printhead. If this printhead heating is severe enough the printhead reliability can be reduced or the printhead can fail. Therefore, it is important that the apparatus used to provide ink from the ink container to the printhead be highly reliable.

The diaphragm pump as disclosed in Ser. No. 08/429,915 now U.S. Pat. No. 5,825,387 includes a chassis and a diaphragm attached to the chassis. Engagement of the diaphragm by an actuator varies the volume of the chamber defined by the chassis and diaphragm. Varying the volume of the chamber allows ink to be selectively drawn into the chamber and selectively expelled from the chamber. Ink is drawn into the chamber from an ink reservoir. Ink expelled from the chamber is transferred to the printhead by way of an ink conduit.

It is important that the ink cartridge for providing pressurized ink to the ink jet printer interact with the printer in such a way that the printer function properly. If the ink cartridge does not interact properly with the printer the printer may not function properly which can result in a reduction of print quality or a reduction in reliability.

Additionally, it is important that the diaphragm pump be highly reliable. The diaphragm pump should be capable of operating over a large number of actuation cycles without leaking. In addition, the ink cartridge should be strong and resistant to rupturing if the ink container is dropped.

The diaphragm on the diaphragm pump should be flexible so that the force required to activate the pump is relatively low. The use of a low activation force diaphragm pump makes it possible to use actuators that have lower output force capability. These lower output force actuators tend to be lower cost than actuators having higher output force requirements, reducing the cost of the printing system. In addition, the use of lower force actuators tends to reduce the cost of a retention system used to secure the ink container to the printer. The use of lower cost retention systems tends to reduce the cost of the printing system.

Finally, the diaphragm pump should provide a consistent discharge volume. This discharge volume should have little variation from ink container to ink container. In addition, the diaphragm pump should be well suited for high volume manufacturing techniques allowing the ink container to be produced at lower cost.

SUMMARY OF THE INVENTION

One aspect of the present invention is a replaceable ink supply cartridge for providing a pressurized supply of ink to an ink-jet printhead of an ink-jet printer. The replaceable ink supply cartridge includes an activation portion for receiving a linear actuator associated with the ink-jet printer. The linear actuator has an activated state and an inactivated state. In the activated state the linear actuator is biased toward an extended position into engagement with the activation portion. In the inactivated state the linear actuator is in a retracted position. The ink supply cartridge portion provides a source of pressurized ink in response to the activated state of the linear actuator. Wherein in response to the inactivated state of the linear actuator the source of pressurized ink is non-pressurized.

DETAILED DESCRIPTION OF THE PREFERRED EMBODIMENT

Figure 1:
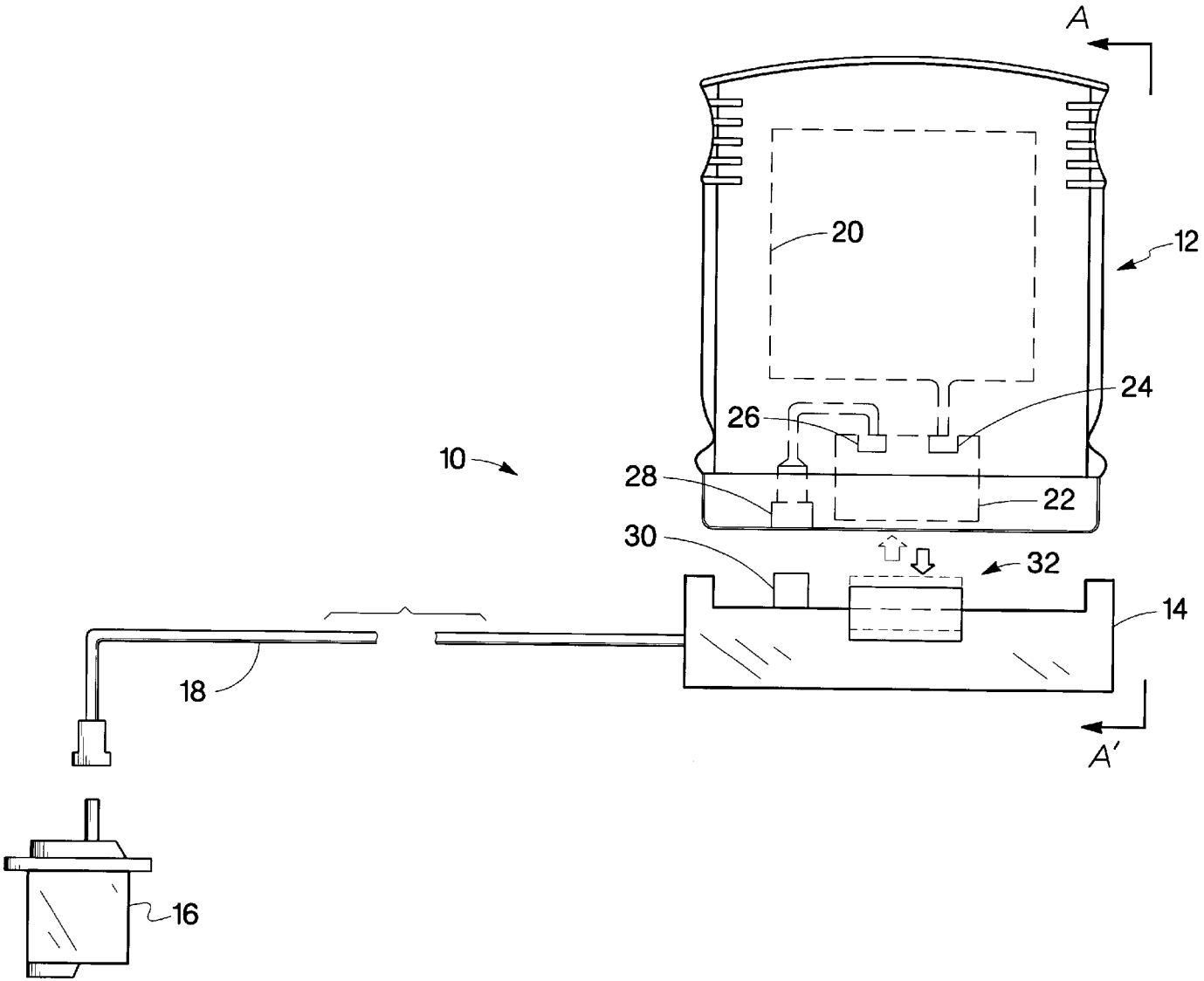
FIG. 1 depicts a schematic representation of an ink container having a diaphragm pump of the present invention for providing ink to an ink-jet printhead.

FIG. 1 depicts an ink-jet printing system 10 that includes an ink container 12 that contains a diaphragm pump of the present invention. The printing system 10 also includes a supply station 14 for receiving the ink container 12. The supply station 14 is fluidly connected to a printhead 16 by a conduit 18.

The ink container 12 includes an ink reservoir 20, a diaphragm pump portion 22 and an inlet 24 for selectively allowing fluid to pass from the ink reservoir 20 to the diaphragm pump portion 22. Also included in the ink container 12 is an ink outlet 26 for selectively allowing fluid to pass from the diaphragm pump portion 22 to a fluid outlet 28.

The supply station 14 includes a fluid inlet 30 and an actuator 32. With the ink container 12 properly positioned in the supply station 14 the fluid outlet 28 associated with the ink container fluidicly connects with the fluid inlet 30 associated with the supply station 14. In addition, proper positioning of the ink container 12 in the supply station 14 allows the actuator 32 to engage the diaphragm pump portion 22. This engagement between the actuator 32 and the diaphragm pump portion 22 produces the passage of fluid from the ink reservoir 20 to the printhead 16. The diaphragm pump portion 22 and actuator 32 ensure a supply of ink is provided to the printhead 16.

Figure 2B:
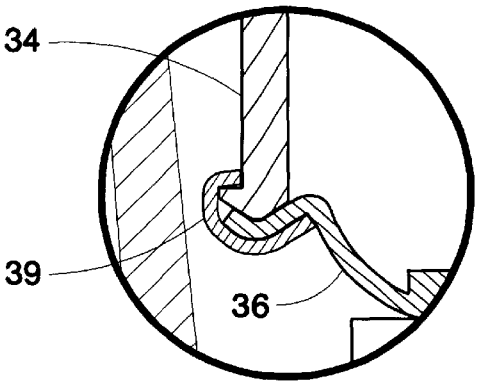
FIG. 2*b* is a greatly enlarged partial sectional view showing details of the disphragm pump circled by dashed lines in FIG. 2*a*.
Figure 2A:
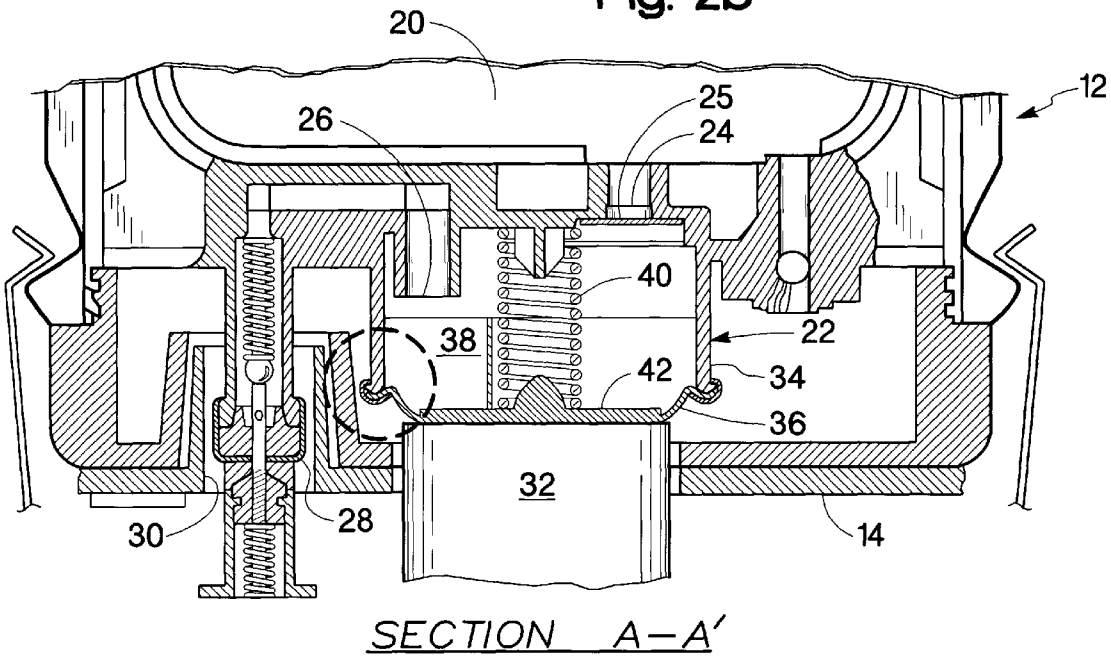
FIG. 2*a* depicts a cross section, shown partially broken away, taken across lines A—A' of the ink container of FIG. 1 shown with an actuator positioned for activating the diaphragm pump.

FIG. 2*a* depicts a sectional view of the ink container 12 mounted to the supply station 14 shown in FIG. 1. The ink container 12 includes the ink reservoir 20 that is in fluid communication with the diaphragm pump portion 22 by an inlet 24. Ink is selectively provided to the diaphragm pump portion 22 through the inlet 24. In one preferred embodiment the inlet 24 includes a check valve 25 for allowing ink to pass from the ink reservoir 20 to the diaphragm pump portion 22 and for limiting ink passage from the diaphragm pump portion 22 to the ink reservoir 20. The diaphragm pump portion 22 expels ink through the outlet 26. Ink expelled from the diaphragm pump portion 22 is then provided to the printhead 16 via the supply station 14 and the conduit 18.

With the ink container 12 properly positioned in the supply station 14 the fluid inlet 30 associated with the supply station engages the fluid outlet 28 associated with the ink container 12 to form a fluid interconnection between the ink container 12 and the supply station 14.

The diaphragm pump portion 22 in the preferred embodiment includes a chassis 34 and a diaphragm 36 that define a variable volume chamber 38. As seen in FIG. 2*b*, the diaphragm 36 in the preferred embodiment is attached to the chassis 34 using a fastening device 39 such as a crimp cap as will be discussed in more detail later. Within the chamber 38 is a biasing means 40 for biasing the diaphragm 36 towards the actuator 32. In the preferred embodiment, the biasing means 40 is a spring that biases a pressure plate portion 42 that is formed integrally with the diaphragm 36.

The actuator 32 is preferably a linear actuator that engages the diaphragm 36 and displaces the diaphragm 36 toward the chamber 38 compressing the spring 40. As the diaphragm 36 is displaced toward the chamber 38 the volume of the chamber 38 is reduced. This reduction in volume of chamber 38 pressurizes the ink within the chamber 38 causing ink to pass through outlet 26 towards the printhead 16. As the actuator 32 is removed the spring 40 relaxes, displacing the diaphragm 36 away from the chamber 38, increasing the chamber 38 volume, and reducing the chamber pressure, allowing ink to flow from the ink reservoir 20 into the chamber 38 through the inlet 24. In the preferred embodiment the inlet 24 is a check valve that provides greater resistance to fluid flow from the chamber 38 to the reservoir 20 than resistance to fluid flow from the ink reservoir 20 to the chamber 38. The fluid flow resistance provided by the valve 25 allows ink to flow only from the ink reservoir 20 to the chamber 38 and limits ink flow from the chamber 38 to the ink reservoir 20. As the diaphragm 36 is displaced toward the chamber 38 pressurizing fluid from within the chamber 38, the valve 25 limits ink passage from the chamber 38 to the ink reservoir 20.

Because valve 25 limits or provides greater resistance to ink flow from the chamber 38 to the ink reservoir 20 than a resistance to fluid flow between the fluid outlet 28 and the printhead 16, pressurized fluid tends to flow from the chamber 38 to the fluid outlet 26, into the fluid inlet 30 through the conduit 18 to the printhead 16.

Once fluid within the chamber 38 is depleted, the actuator 32 is retracted away from the diaphragm 36. As the actuator 32 is retracted, the diaphragm 36 springs back expanding the volume of chamber 38. As the volume of the chamber 38 is expanded the pressure within the chamber 38 is reduced allowing fluid to be drawn into the chamber 38 from the reservoir 20 through the fluid inlet 24. Because the fluid flow resistance to fluid flow into the chamber 38 at the fluid inlet 24 is less than the fluid flow resistance to fluid flow into the chamber 38 at the fluid outlet 28, fluid from the ink reservoir replenishes the chamber 38 not fluid from the printhead 16.

Figure 3:
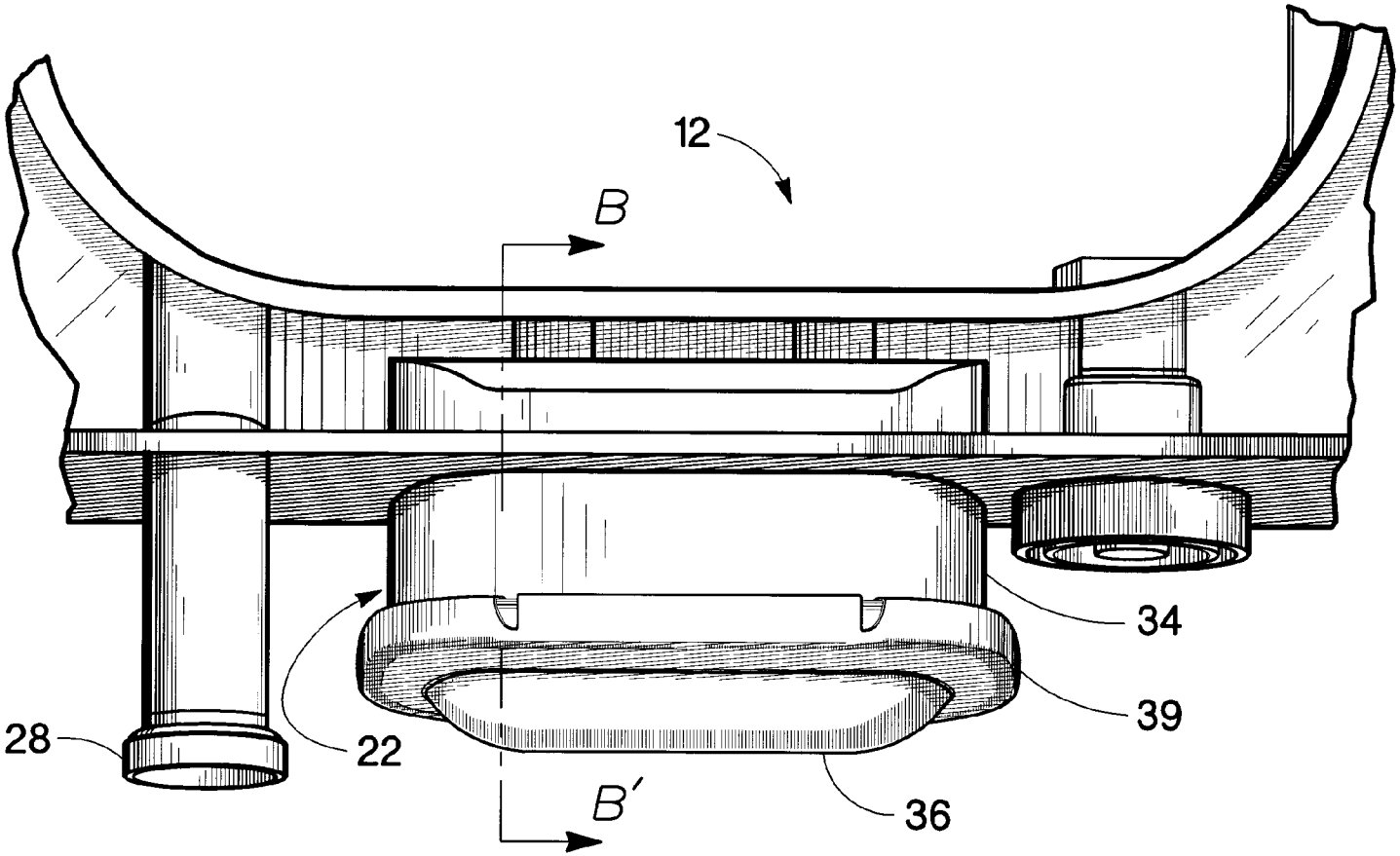
FIG. 3 represents a perspective view of the diaphragm pump of FIG. 2*a*.

FIG. 3 is a perspective view of the diaphragm pump portion 22 of the present invention. The diaphragm pump portion 22 is formed integrally with the ink chassis 34. The diaphragm pump portion 22 includes the chassis 34 and the diaphragm 36. The fastening device 39 mechanically holds the diaphragm 36 in compression with the chassis 34 to form a seal between the diaphragm 36 and the chassis 34. Although the preferred embodiment makes use of a crimp cap as the fastening device 39 any other mechanical fastening device for maintaining the diaphragm 36 in compression with the chassis 34 may also be suitable.

The ink container 12 has a leading edge relative to an insertion direction of the ink container 12 into the supply station 14. The leading edge is configured to have a minor axis and major axis perpendicular to the direction of insertion of ink container 12 into supply station 14. To allow for a compact arrangement of ink containers 12 in supply station 14, fluid outlet 28 and pump portion 22 are arranged along the major axis. Because the actuator 32 has a fixed stroke or travel distance between fully extended and retracted positions, the pump diaphragm should have a minimum cross sectional area relative to the direction of insertion to provide a required volume of fluid. The pump portion 22 has a minor axis and a major axis perpendicular to the direction of insertion. The pump portion is configured and arranged relative to the ink container 12 such that the major axis of the pump portion 22 is aligned with the major axis of the ink container 12. The use of both ink container 12 and pump portion 22 that have an elongate shape in the insertion direction and the alignment of the major axes of the pump portion 22 with the ink container 12 allows compact arrangement for the ink container 12 as well as a compact arrangement for the supply station 14.

Figure 4:
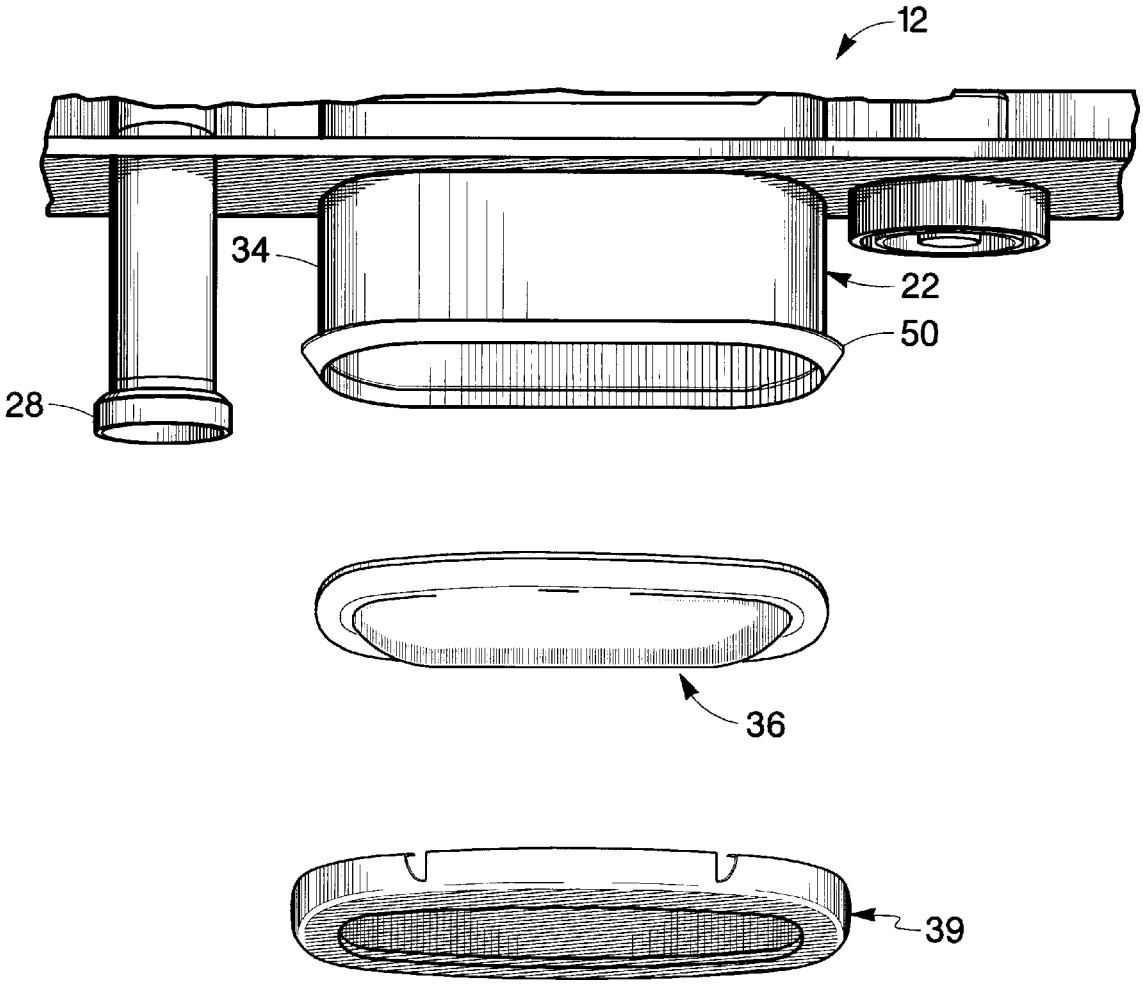
FIG. 4 depicts an exploded view of the diaphragm pump shown in FIG. 2*a*.

FIG. 4 depicts an exploded view of the preferred embodiment of the diaphragm pump portion 22 shown in FIG. 3. The diaphragm 36 is preformed to have an elongate dome shape. The fastening device 39 has a base portion having an opening therein. The fastening device 39 is positioned on the chassis 34 with the diaphragm positioned therebetween such that the elongate dome portion extends at least partially through the hole in the base portion of the fastening device 39. The fastening device 39 is crimped or folded over a flange 50 on the chassis 34 form a secure compression seal between the chassis 34 and the diaphragm 36.

Figure 5A:
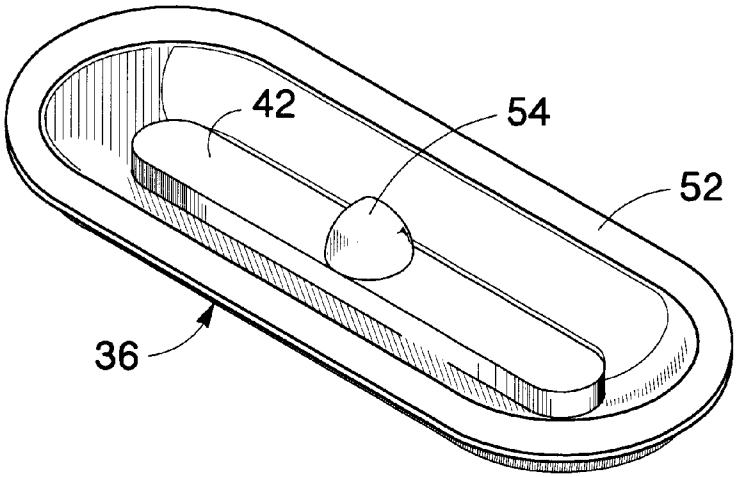
FIG. 5*a* depicts a perspective view of a diaphragm of the present invention having an integral pressure plate.

FIG. 5*a* depicts the preferred diaphragm 36 in perspective as viewed from the chassis 34. The diaphragm 36 includes a sealing surface 52, the pressure plate portion 42 and a spring engagement portion 54 extending upward from the pressure plate portion 42. In the preferred embodiment, the sealing surface 52, the pressure plate portion 42 and the spring engagement portion 54 are each integral with the diaphragm 36.

In the preferred embodiment the diaphragm 36 is made from a compressible material which can be held in compression by the fastening device 39 so that the sealing surface 52 forms a good fluid seal with the chassis 34. This compressible material should be capable of withstanding large pressure loads without leaking or failing. The diaphragm 36 must be able to withstand large pressure spikes that can occur when the ink container 12 is dropped. In addition the diaphragm 36 should have a high fatigue life capable of operating over a large number of pumping cycles. Finally, the diaphragm 36 should be of a material selected to provide a fluid barrier to fluids within the diaphragm pump portion 22. Aqueous inks that are frequently used in ink-jet printing contain water. Therefore, the diaphragm 36 should provide a good barrier to water.

The diaphragm 36 outer surface opposite the chamber 38 is in contact with air. Therefore, the diaphragm 36 should prevent air from permeating through the diaphragm 36 adding to air bubbles inside the chamber 38. Air permeation through the diaphragm 36 increases the probability of bubbles passing to the printhead 16 which can reduce printhead 16 reliability and reduce print quality. In addition, the diaphragm 36 should also provide a barrier to the loss of water vapor from the chamber 38. Therefore, the diaphragm 36 should be formed of a material having a low permeability. In addition the diaphragm 36 should have a high fatigue life capable of operating over a large number of pumping cycles without substantial increase in permeability and should be well suited to mechanical fastening.

In one preferred embodiment the diaphragm 36 is formed from a molded elastomer diaphragm formed of Ethylene-Propylene-Diene Monomer (EPDM). EDPM materials are discussed in more detail in "Science and Technology of Rubber", editors James E. Mark, Burak Ehrman, and F. R. Eirich, Academic Press, London, 1994, p. 34. The diaphragm 36 can be formed in a variety of shapes such as a round or oval domed shape. It is preferred that the diaphragm 36 is thermally formed to have an elongate dome shape. The central portion of the dome has a thickened portion defining the pressure plate 42. The spring engagement feature 54 is formed centrally on the pressure plate 42. In this preferred embodiment the diaphragm 36, pressure plate 42 and engagement portion 54 are molded from the same material. Alternatively, a stiffener such as sheet metal can be insert molded into the diaphragm 36 to stiffen the diaphragm 36 thereby forming a pressure plate 42 within the diaphragm 36.

There is a tradeoff between the permeability of the diaphragm 36 and the stiffness or force required to deform the diaphragm 36. For example, doubling the thickness of the elastomer material used reduces the permeability of this material by one half. However, the increase in thickness of the elastomer material increases the stiffness of the material or force required to actuate the pump. Therefore, the thickness of the material should be selected to minimize the permeability while providing an activation force that is within the range of activation forces of the actuator 32. In the preferred embodiment, the elastomer is a mixture of Bromo Butyl and EPDM material having a nominal hardness of 67 shore A. durometer.

Figure 5B:
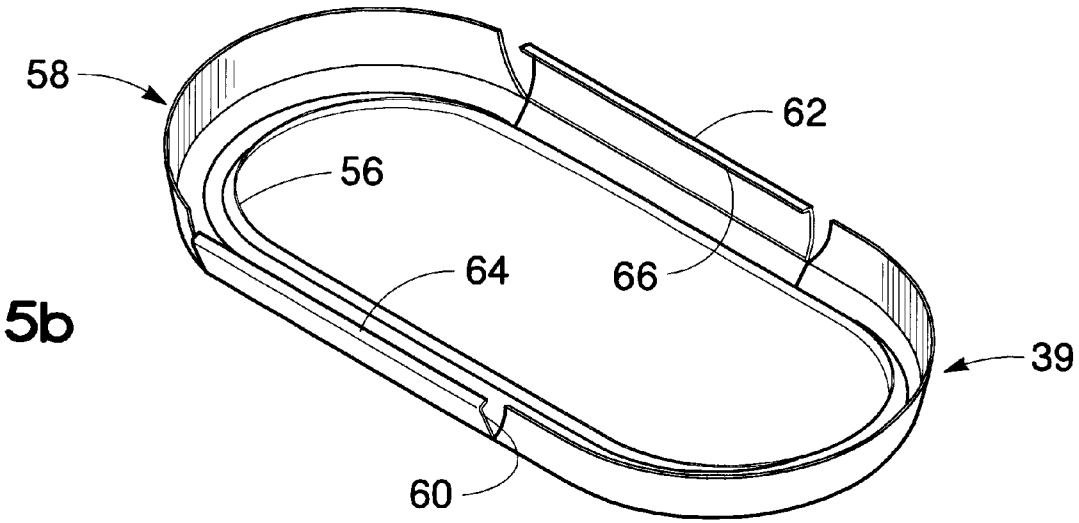
FIG. 5*b* depicts a perspective view of a fastening device of the present invention for fastening the diaphragm of FIG. 5*a* to a pump chassis.

FIG. 5*b* depicts a preferred embodiment of the fastening device 39 for fastening the diaphragm 36 to the chassis 34. The fastening device 39 includes a base portion 56 and upright sides 58 extending generally upward from the base portion 56. The base portion 56 is elongated along an axis of elongation. The upright sides 60 and 62 on either side of the axis of elongation are gull winged, extending upward and outward away from the base portion 56. Each of the gull winged upright sides 60 and 62 include an engagement portion 64 and 66, respectively, disposed toward an end of the upright sides, opposite the base portion 56. As will be discussed next with respect to FIGS. 6*a*–6*d* the use of gull winged upright sides 60 and 62 having engagement portion 64 and 66 allows the upright sides to be compressed together for reliably attaching the diaphragm 36 to the chassis 34.

Figure 6A:
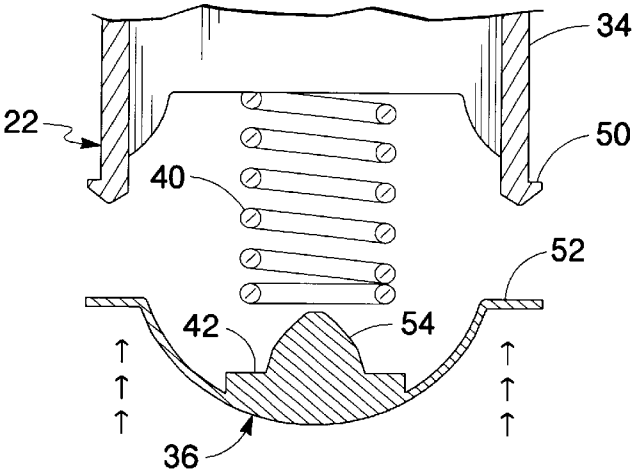
FIGS. 6*a*, 6*b*, 6*c*, and 6*d* depicts a sequence of sectional views taken across lines B–B' of FIG. 3 illustrating the fastening of the diaphragm to a chassis using a crimp cap of the present invention.
Figure 6C:
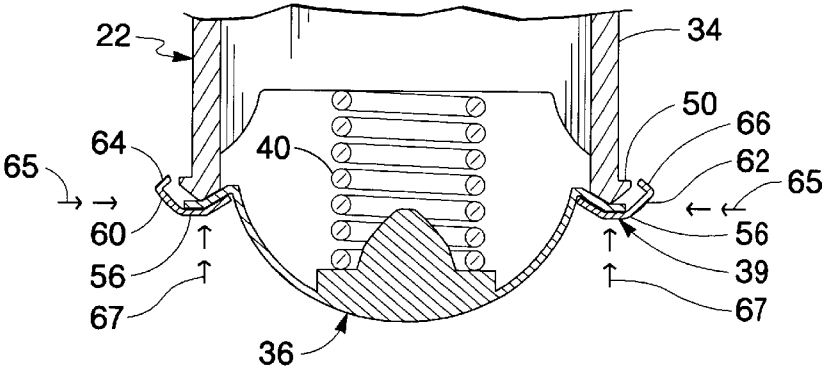
Figure 6B:
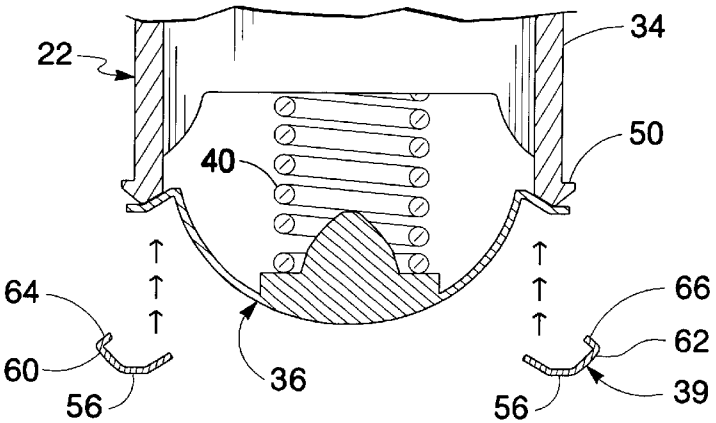

FIGS. 6*a*–6*d* represents a section view taken across lines B–B' of FIG. 3 illustrating an assembly sequence illustrating the preferred method for attaching the diaphragm 36 to the chassis 34. The diaphragm 36 is positioned on the chassis 34 such that the sealing surface 52 associated with the diaphragm 36 engage a corresponding sealing surface associated with the chassis 34 as shown in FIGS. 6*a* and 6*b*. In addition, the spring engagement portion 54 is aligned to engage the spring 40 associated with the chassis 34 to maintain the spring 40 in engagement with the pressure plate 42. The remaining upright sides 58 associated with the fastening device 39 are crimped in a manner similar to that discussed in patent application Ser. No. 08/846,785 now U.S. Pat. No. 5,854,646 and therefore will not be discussed here.

Figure 6D:
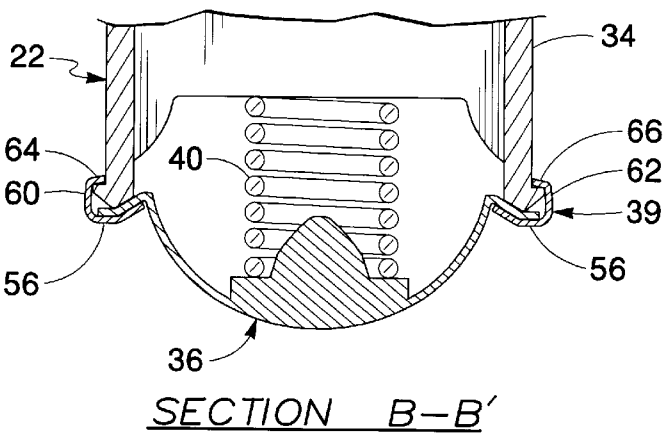

FIGS. 6*b*, 6*c*, and 6*d* depict the step of positioning the fastening device 39 proximate the chassis 34 such that the engagement portions 64 and 66 are aligned with the flange 50 associated with the chassis 34. Illustrated using arrows 65 in FIG. 6*c* opposing forces are applied to each of the upright sides 60 and 62 to urge these upright sides inwardly towards the chassis 34. Coincident with the opposing forces represented by arrows 65 a counteracting force represented by arrows 67 is applied to capture a countersink portion of the fastening device 39. As the upright sides 60 and 62 are urged inwardly towards the chassis corresponding engagement portions 64 and 66 engage the flange 50 associated with the chassis 34 to secure the diaphragm 36 to the chassis 34. The counteracting forces prevent improper deformation of the fastening device 39 as well as prevent bowing of the chassis 34. With the diaphragm 36 secured to the chassis 34 a fluidic seal is formed between the diaphragm 36 and the chassis 34. In the preferred embodiment, the diaphragm 36 is in compression against the chassis 34 to form a reliable compression seal.

The use of preformed upright gull-wings 60 and 62 simplifies the attachment of the fastening device 39 to the chassis 34. Without the use of the preformed gull-winged upright sides the application of a force to fold the upright sides 58 over the flange 50 tends to result in buckling of the upright sides 58 along the longitudinal axis of the chassis 34.

The use of preformed gull-winged upright sides 60 and 62 improves the reliability of the attachment of the fastening device 39 to the chassis 34 by not requiring folding of upright sides 58 along the longitudinal axis. Instead, the preformed upright sides 60 and 62 are positioned along the longitudinal axis. The preformed gull-winged upright sides 60 and 62 requires only an inward force 65 and a counter-acting force 67 and does not require folding. This inward force tends to not result in buckling of the upright sides 58 or the chassis 34.

Figure 7A:
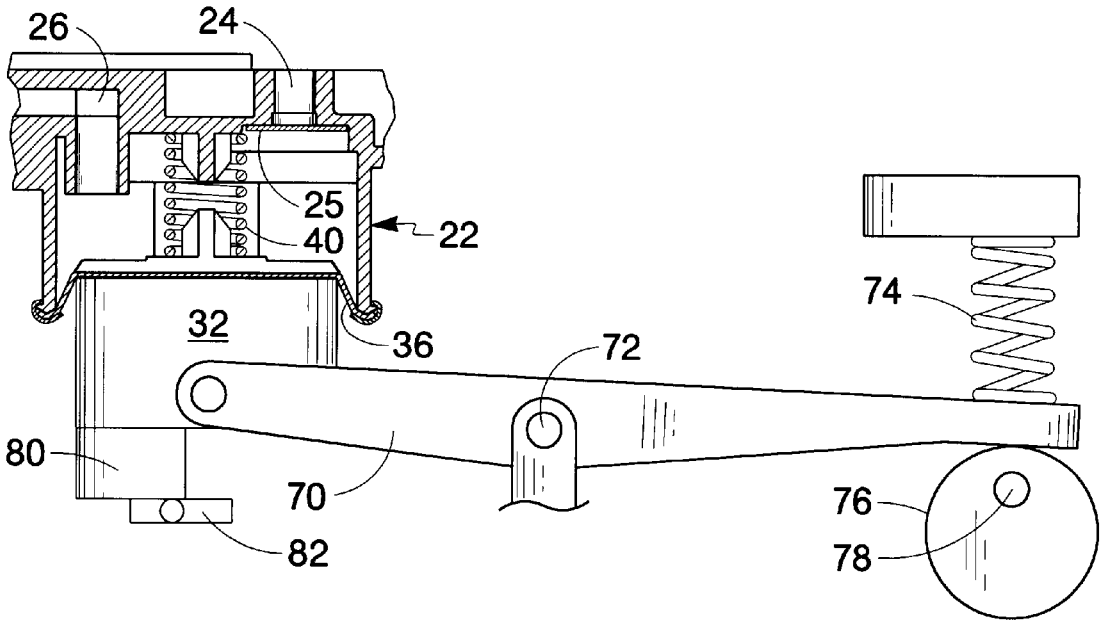
FIGS. 7*a* and 7*b* depict a representation of an actuator for actuating the diaphragm pump of the present invention shown in an extended position and a retracted position.
Figure 7B:
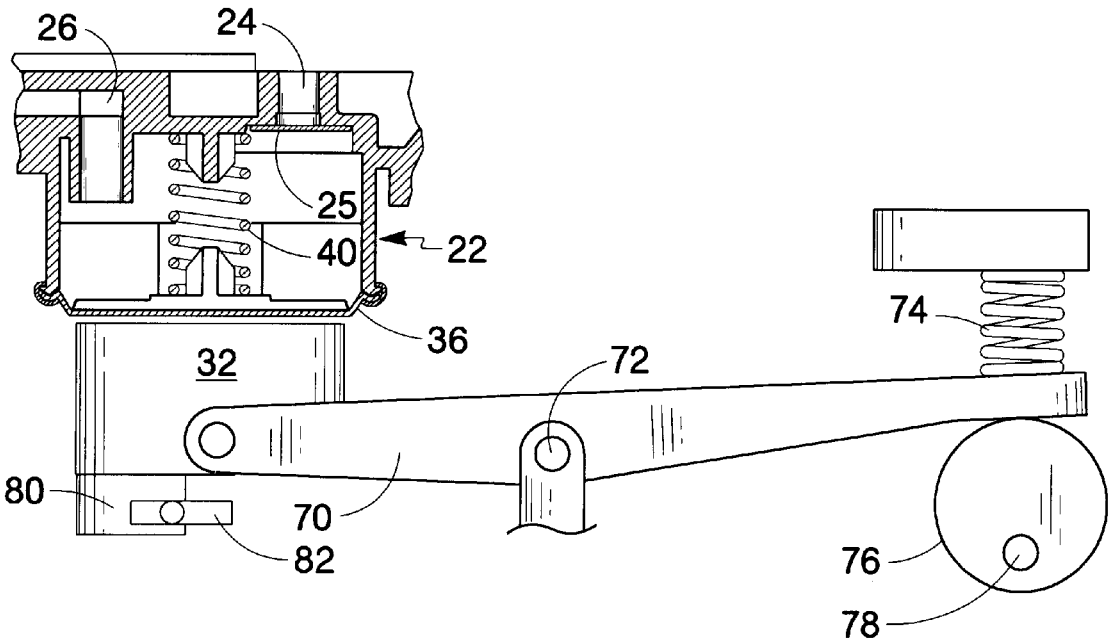

Before discussing the operation of the pump portion 22 in detail, it will be helpful to first discuss the characteristics of the actuator 32 illustrated by the representation shown in FIGS. 7*a* and 7*b*. The actuator 32 in a preferred embodiment is pivotally coupled to one end of a lever 70 that is supported on a pivot point 72. The other end of the lever 70 is biased downward by a compressed spring 74. The spring biasing force urges the lever downward thereby urging the actuator positioned opposite the pivot point 72 in an upward direction as shown in FIG. 7*a*. A cam 76 is mounted on a rotatable shaft 78 and is positioned such that rotation of the shaft 78 engages the lever 70 to move the actuator 32 in a linear direction between an extended position shown in FIG. 7*a* wherein the actuator 32 is fully extended and a retracted position shown in FIG. 7B wherein the actuator 32 is fully retracted.

An actuator position sensing device such as flag 80 and an optical detector 82 identify that the actuator 32 is extended beyond a threshold amount. In the preferred embodiment the flag 80 and optical detector 82 identify that the actuator 32 has reached the fully extended position. The optical detector 82 receives a beam of light to actuate the actuator if the actuator is extended beyond the threshold amount. If activated the actuator provides this information to a printer control portion (not shown). The printer control portion selectively activates the cam 76 to repressurize the pump portion 22 upon the occurrence of this optical detector signal. If the actuator 32 is extended less than the threshold amount then the flag 80 deactivates the optical detector 82 by preventing light from a corresponding light source (not shown) from impinging upon the detector 82.

Figure 8A:
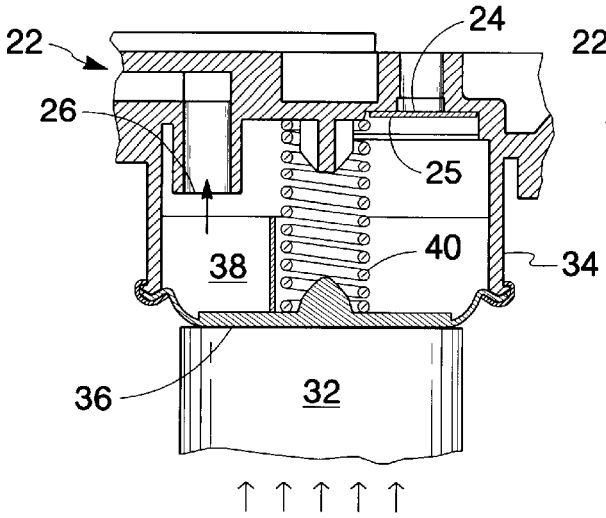
FIGS. 8*a*, 8*b*, 8*c*, 8*d*, and 8*e* depicts a sequence of cross-section views as shown in FIG. 2*a* illustrating operation of the diaphragm pump of the present invention.
Figure 8D:
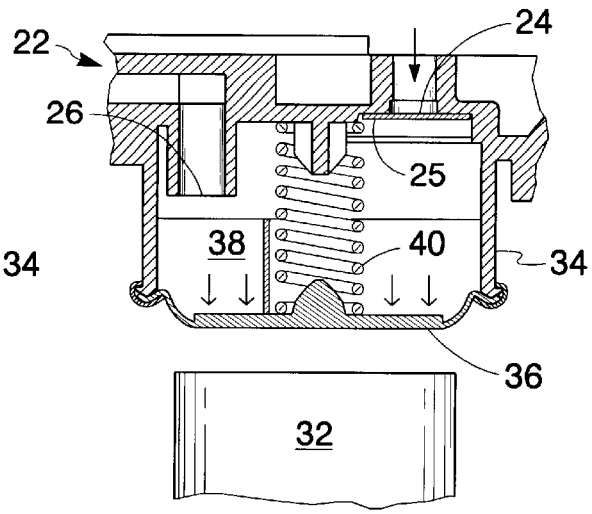
Figure 8B:
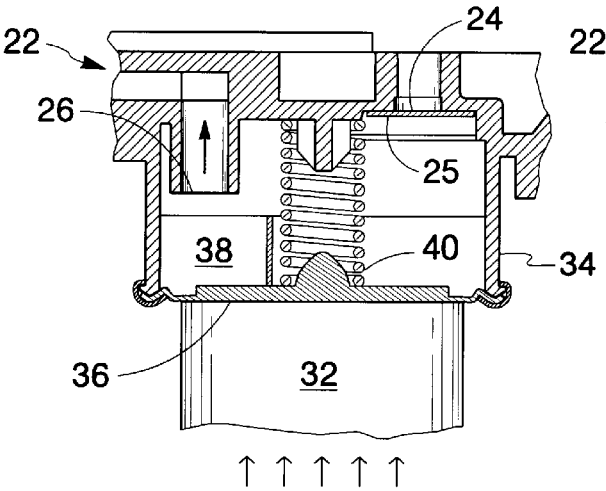
Figure 8E:
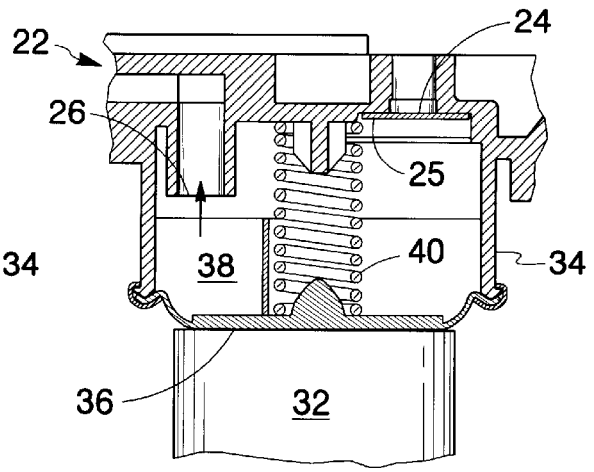
Figure 8C:
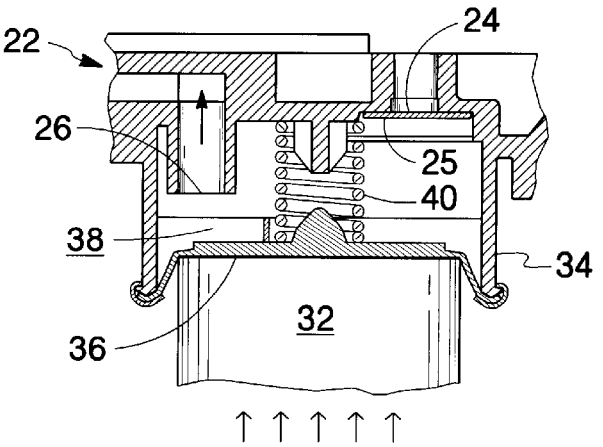

FIGS. 8*a*–8*e* depict the operation of the diaphragm pump portion 22 of the present invention. FIG. 8*a* depicts the beginning of the pump cycle wherein the actuator 32 engages the diaphragm 36 and biases the diaphragm to pressurize fluid in the chamber 38. The check valve 25 is closed preventing or providing resistance to fluid flow from the chamber 38 to the reservoir 20. Because the valve 25 provides greater resistance to fluid flow out of the chamber 38 than the fluid outlet 26, then fluid flows from the fluid outlet 26. As ink is ejected from the printhead 16 the diaphragm 36 is biased inward to displace ink from the chamber 38 to replace the ejected ink as shown in FIGS. 8*b* and 8*c*. Once the actuator 32 is fully extended and the volume of the chamber 38 is minimized or the chamber is in a contracted state the optical detector 82 is activated. The printer control portion then selectively initiates a refresh cycle as is discussed with respect to FIGS. 8*d* and 8*e*.

FIGS. 8*d* and 8*e* depict a refresh cycle by activating cam 76 shown in FIGS. 7*a* and 7*b* wherein the actuator 32 is removed from engagement with the diaphragm 36. The removal of the actuator 32 from the diaphragm 36 allows the biasing means 40 to expand pushing the diaphragm 36 toward the actuator 32. As the diaphragm moves outwards towards the actuator 32 the volume of the chamber 38 increases drawing fluid from the ink reservoir 20 through check valve 25 to replenish the chamber 38. Because the fluid flow resistance is less for fluid flow from the fluid inlet 24 than for fluid flow from the fluid outlet 26, chamber 38 is replenished from the ink reservoir 20 and not the printhead 16.

Figure 9:
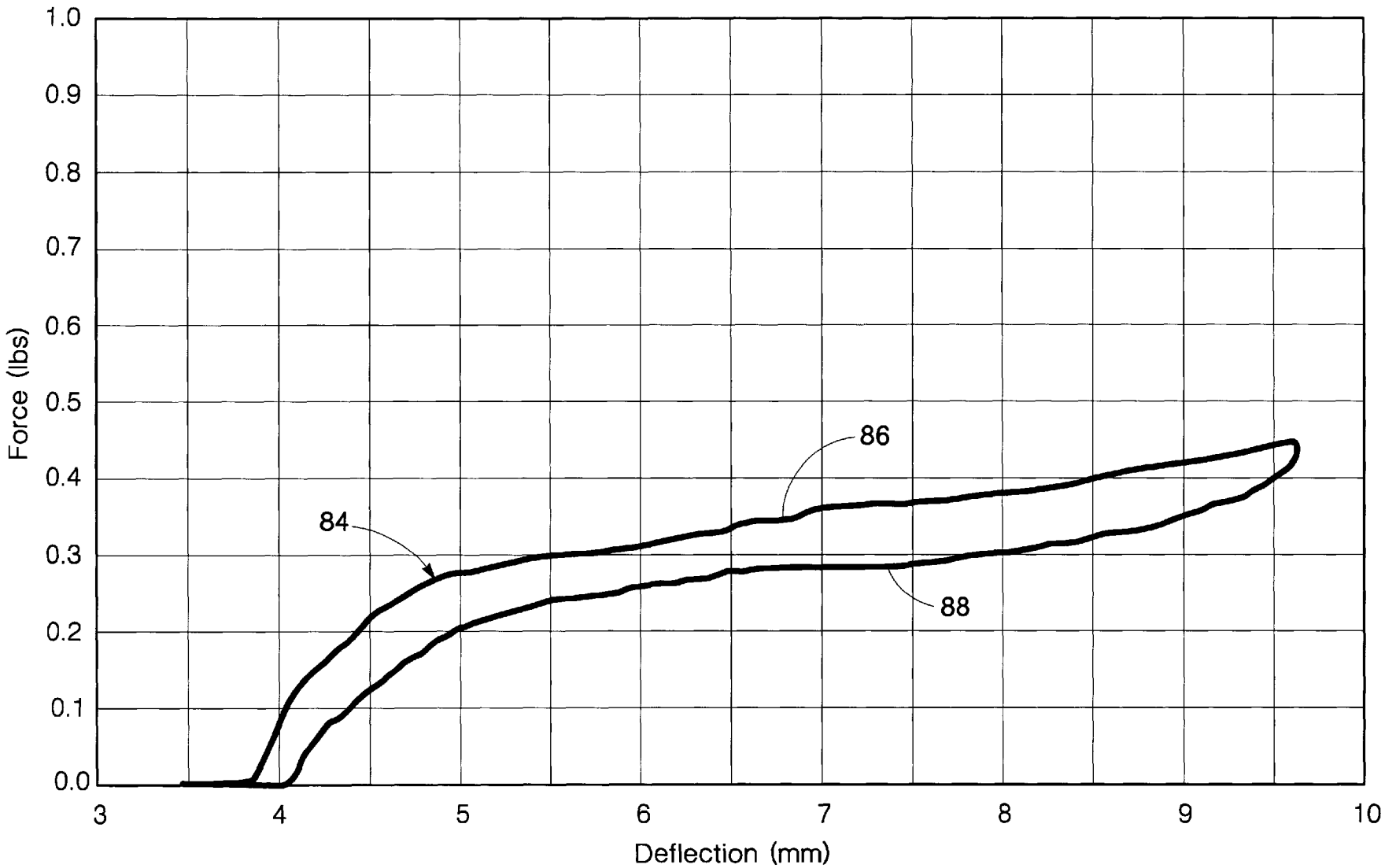
FIG. 9 depicts an actuation force versus displacement curve for the preferred diaphragm of the present invention.

FIG. 9 represents actuation force versus deflection curves for the diaphragm 36. It is important that the diaphragm 36 exhibit a relatively low actuation force so that the force required for retaining the ink container 12 in the supply station 14 is relatively small. It is preferable that the nominal actuation force be less than 0.8 pounds. In the preferred embodiment the nominal actuation force is less than 0.5 pounds. In addition, it is important that the diaphragm have a return force that is high enough to generate enough backpressure in the chamber 38 during the refresh cycle to rapidly refill the chamber 38 with ink. Finally, it is important that similar force vs. displacement curves be exhibited for both actuation and refresh cycles.

FIG. 9 represents a nominal activation force versus deflection curve 84 for the diaphragm 36 of the present invention. The actuation of the diaphragm 36 by the actuator 32 is represented by curve portion 86 and the return of the diaphragm 36 by spring 40 is represented by curve portion 88. It can be seen from FIG. 9 that the activation force is less than 0.5 pounds. The low actuation force is accomplished by designing the flexing portion of the diaphragm 36 to be relatively thin and using a diaphragm material of high resilience. The use of a relatively thin flexing portion of high resilience allows the spring 40 to overcome unbuckling forces in the flexing portion, allowing the return force versus displacement curve to more precisely match the actuation force curve. The diaphragm material of the present invention is selected such that the curve 84 has a high initial and final slope and a low middle slope. Once sufficient activation force is applied, the diaphragm 36 tends to buckle over or roll in thereby reducing the activation force required producing a relatively low slope portion of the curve. As discussed previously, it is important that the activation force be relatively low to reduce the requirements of the actuator 32 thereby reducing the cost of the printing system. It is also important that the diaphragm 36 have sufficient stiffness to recover relatively quickly thereby generating sufficient suction force to draw ink into the ink chamber 38 through the check valve 25 as shown in FIGS. 7*a*–7*e*. Another advantage of the present invention is the use of a thickened pressure plate portion 42 that assures that the diaphragm 36 returns completely in a predictable manner.

Figure 10:
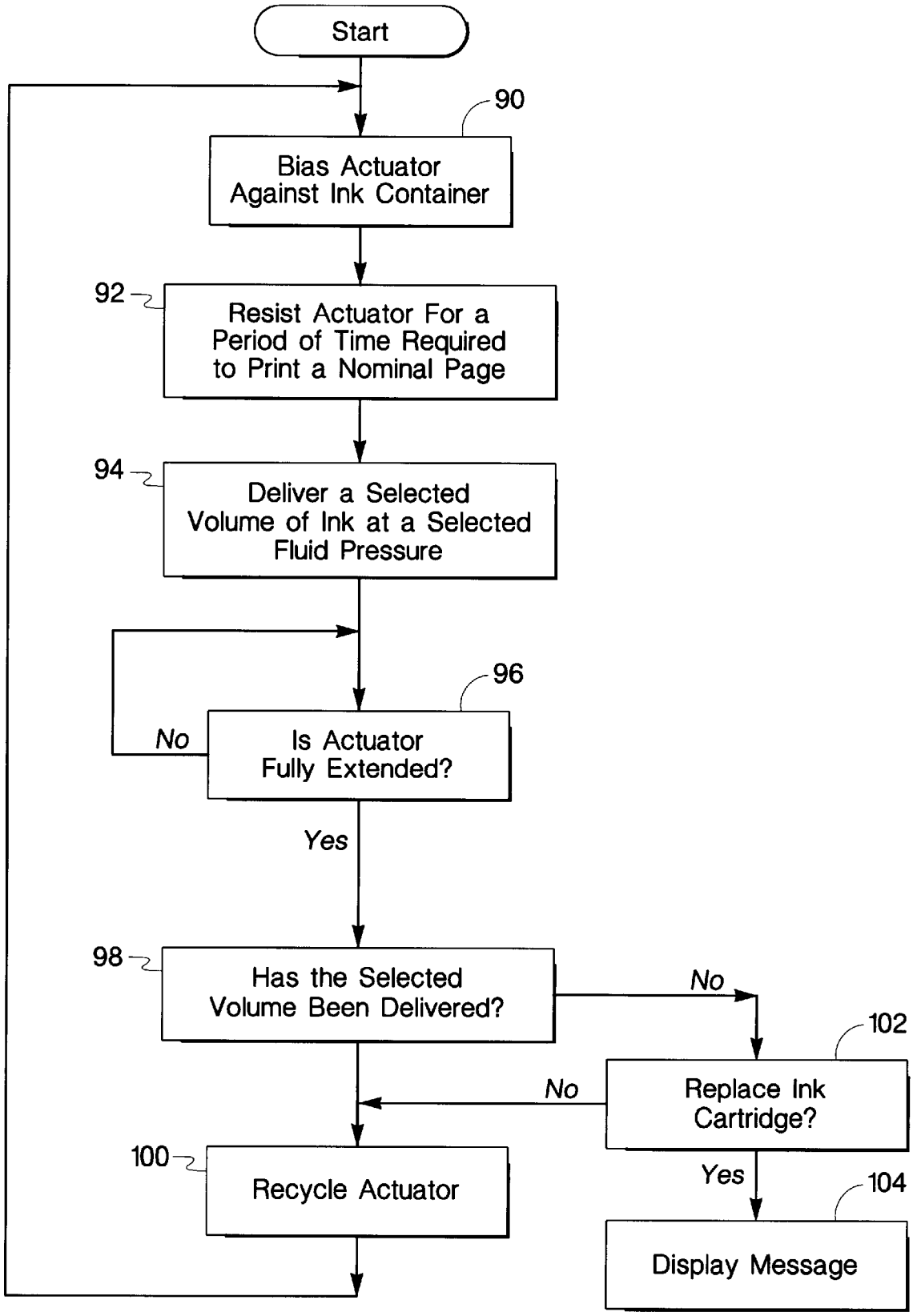
FIG. 10 depicts a method of the present invention for supplying fluid to an ink jet printer in response to actuation by the actuator.

FIG. 10 depicts a method of the present invention for supplying ink to an ink jet printer in response to actuation by the actuator. Once image information is received by the printer, printing is initiated by biasing the actuator to engage the replaceable ink container 12 as represented by step 90. In response to the engagement of the ink container 12, the ink container provides resistance to the linear motion of the actuator as represented by step 92. The ink container 12 delivers a selected volume of ink at a selected fluid pressure to the printer as represented by step 94. It is important that the ink container 12 provide a volume that is at least the selected volume because the inkjet printer expects the selected volume for each actuation cycle in which the actuator 32 is moved from the retracted position to the extended position. The selected volume is selected to be sufficient ink to accomplish printing a nominal page (i.e., a normal print job). In one preferred embodiment, the selected volume is equal to 0.2 cubic centimeters. It is also important that the resistance provided by the ink container 12 prevent the actuator from reaching the fully extended position too quickly that results in the activation of the optical detector prior to the completion of at least a portion of the print job.

Once the actuator 32 is biased against the ink container in step 90 the printer control portion checks for the occurrence of the optical detector 82 active condition indicating that the actuator 32 is fully extended represented by step 96. If the actuator 32 is fully extended a determination is made whether the selected volume of ink has been delivered to the printer as represented in step 98. If the selected volume has been delivered and the print job is not complete then the actuator 32 is recycled or retracted as represented in step 100 and then again biased against the ink container 12 as represented in step 90. It is important that the pump chamber 38 refill with ink from the reservoir 20 prior to the step 90 where the actuator 32 is biased against the ink container. In one preferred embodiment the pump chamber 38 must refill in less than 2.5 seconds.

If the are selected volume has not been delivered in step 98 then a determination is made whether the ink container 12 needs to be replaced as represented by step 102. Because there are several reasons why the selected volume may not have been delivered other that an out of ink condition, these other conditions should be tested to determine if an out of ink condition has occurred. For example, the selected volume may not be delivered if the diaphragm 36 associated with the ink container 12 is biased by the actuator for sufficient time that ink within the chamber leaks around check valve 25 instead of being delivered to the printhead 16. This condition should be identified so that an out of ink condition is not erroneously generated. If an out of ink condition has occurred then the user is informed of this condition as represented by step 104.

What is claimed is:

1. A replaceable ink supply cartridge for providing a pressurized supply of ink to an ink-jet printhead of an ink-jet printer, the replaceable ink supply cartridge comprising:

a housing insertable to and removable from the ink-jet printer, the housing including:

an activation portion for receiving a movable linear actuator associated with the ink-jet printer when the housing is inserted to the ink-jet printer, the linear actuator having an activated state and an inactivated state, wherein in the activated state the linear actuator is biased toward an extended position into engagement with the activation portion and wherein in the inactivated state the linear actuator is in a retracted position;

wherein the ink supply cartridge provides ink to the ink-jet printhead for printing that is pressurized in response to the activated state of the linear actuator; and wherein in response to the inactivated state of the linear actuator, the ink is non-pressurized.

2. The replaceable ink supply cartridge of claim 1 wherein the activation portion is a variable volume chamber, the variable volume chamber having an expanded volume and a contracted volume, wherein in the activated state the linear actuator biases the variable volume chamber to reduce a chamber volume to pressurize ink within the variable volume chamber to provide ink that is pressurized to the ink-jet printer.

3. The replaceable ink supply cartridge of claim 1 wherein the activation portion includes:

a variable volume chamber having an expanded volume and a contracted volume;

a valve interposed in between the variable volume chamber and a supply of ink, the valve providing an inlet resistance to fluid flow from the supply of ink to the variable volume chamber and an outlet resistance to fluid flow from the variable volume chamber to the supply of ink;

wherein the variable volume chamber is responsive to selective application of a biasing force to the variable volume chamber to reduce a chamber volume from the expanded volume to the contracted volume, and wherein the outlet resistance to fluid flow from the variable volume chamber to the supply of ink is greater than a fluid flow resistance associated with fluid flow into a fluid inlet associated with the ink-jet printer to provide the pressurized ink to the ink-jet printhead; and wherein the variable volume chamber is responsive to selective application of a biasing force to increase the chamber volume from the contracted volume, and wherein the inlet resistance is less that the outlet resistance to draw ink from the supply of ink.

4. The replaceable ink supply cartridge of claim 1 wherein the activation portion provides a volume of pressurized ink in the activated state of the linear actuator, and wherein the volume of pressurized ink is selected to be sufficient to accomplish printing a nominal page.

5. The replaceable ink supply cartridge of claim 1 wherein the activation portion provides a volume of pressurized ink in the activated state of the linear actuator that is greater than 0.2 cubic centimeters.

6. The replaceable ink supply cartridge of claim 1 wherein the activation portion provides resistance to movement of the linear actuator during the activated state.

7. A replaceable ink supply cartridge for providing a pressurized supply of ink to an ink-jet printhead of an ink-jet printing system, the replaceable ink supply cartridge comprising:

a housing insertable to and removable from the ink-jet printing system;

a variable volume chamber within the housing having an expanded volume and a contracted volume;

a valve interposed in between the variable volume chamber and a supply of ink within the housing to limit passage of ink from the variable volume chamber to the supply of ink and allowing the passage of ink from the supply of ink to the variable volume chamber;

wherein when the housing is inserted to the ink-jet printing system the variable volume chamber is responsive to selective application of a biasing force to reduce a chamber volume from the expanded volume to the contracted volume to provide the pressurized supply of ink to the ink-jet printhead to be used during printing; and wherein the variable volume chamber is responsive to selective application of a biasing force to increase the chamber volume from the contracted volume to the expanded volume to draw ink from the supply of ink without the use of a further valve interposed between the variable volume chamber and the ink-jet printhead.

8. The replaceable ink supply cartridge of claim 7 wherein ink flow resistance of an ink path between the variable volume chamber and the ink-jet printhead limits ink flow from the ink path to the variable volume chamber during increases in chamber volume.

9. The replaceable ink supply cartridge of claim 7 wherein the ink-jet printer has a fluid inlet associated therewith, the fluid inlet having an inlet flow resistance associated with fluid flow into the fluid inlet and an outlet flow resistance associated with fluid flow out of the fluid inlet, wherein the valve provides a valve inlet resistance to fluid flow from the supply of ink to the variable volume chamber and a valve outlet resistance to fluid flow from the variable volume chamber to the supply of ink, wherein the valve outlet resistance is greater than the inlet flow resistance associated with fluid flow into the fluid inlet to provide the pressurized supply of ink to the ink-jet printer during reduction of the chamber volume, and wherein the valve inlet resistance is less than the outlet flow resistance associated with the fluid flow from the fluid inlet to draw ink from the supply of ink during expansion of the chamber volume.

10. The replaceable ink supply cartridge of claim 7 wherein the variable volume chamber includes a biasing means to resist reduction of the chamber volume from the expanded volume to the contracted volume.

11. The replaceable ink supply cartridge of claim 7 wherein the biasing force is provided by an actuator movable between a retracted state and an extended state.

12. A replaceable ink supply cartridge for providing a pressurized supply of ink to a fluid inlet associated with an ink-jet printer, the fluid inlet having an inlet flow resistance associated with fluid flow into the fluid inlet and an outlet flow resistance associated with fluid flow out of the fluid inlet, the replaceable ink supply cartridge comprising:

a housing insertable to and removable from the ink-jet printer;

a variable volume chamber within the housing having an expanded volume and a contracted volume;

a valve interposed in between the variable volume chamber and a supply of ink within the housing, the valve providing valve inlet resistance to fluid flow from the supply of ink to the variable volume chamber and a valve outlet resistance to fluid flow from the variable volume chamber to the supply of ink;

wherein when the housing is inserted to the ink-jet printer the variable volume chamber is responsive to selective application of a biasing force to the variable volume chamber to reduce a chamber volume from the expanded volume to the contracted volume, and wherein the valve outlet resistance is greater than the inlet flow resistance associated with fluid flow into the fluid inlet to provide the pressurized supply of ink to the ink-jet printer to be used during printing; and wherein the variable volume chamber is responsive to selective application of a biasing force to increase the chamber volume from the contracted volume, and wherein the valve inlet resistance is less than the outlet flow resistance associated with the fluid flow from the fluid inlet to draw ink from the supply of ink.

13. The replaceable ink supply cartridge of claim 12 wherein the biasing force is provided by a linear actuator having an activated state and an inactivated state, wherein in the activated state the linear actuator is biased toward an extended position into engagement with the variable volume chamber and wherein in the inactivated state the linear actuator is in a retracted position.

14. A replaceable ink cartridge for providing ink to an ink-jet printer, the ink-jet printer of the type having a movable linear actuator having an activated state and an inactivated state, in the activated state the linear actuator is biased toward an extended position and in the inactivated state the linear actuator is in a retracted position, the replaceable ink cartridge comprising:

a housing insertable to and removable from the ink-jet printer, the housing including:

an ink source; and an ink delivery portion in fluid communication with the ink source, the ink delivery portion, when the housing is inserted to the ink-jet printer, receiving the linear actuator and providing a volume of pressurized ink to a printhead of the printer for printing in response to linear actuator movement between the retracted position and the extended position, wherein the volume of ink is selected to be sufficient to accomplish printing a nominal page.

15. The replaceable ink cartridge of claim 14 wherein the volume of ink delivered is at least 0.2 cubic centimeters.

16. A replaceable cartridge for providing a supply of ink to an ink-jet printhead of an ink-jet printer, the replaceable cartridge comprising:

a housing insertable to and removable from the ink-jet printer, the housing including:

a receiving portion for receiving a linear actuator associated with the ink-jet printer when the housing is inserted to the ink-jet printer, the linear actuator having an activated state and an inactivated state, wherein in the activated state the linear actuator is biased toward an extended position into engagement with the receiving portion and wherein in the inactivated state the linear actuator is in a retraced position;

wherein the replaceable cartridge provides a source of pressurized ink that is transferred to the printing system to replace ink being ejected for printing by the printhead during the activated state of the linear actuator; and wherein ink is not transferred to the printing system during the inactivated state of the linear actuator.

17. The replaceable cartridge of claim 16, wherein the receiving portion includes a variable volume chamber that provides the pressurized ink in response to the activated state of the linear actuator.

18. The replaceable cartridge of claim 16, wherein the receiving portion resists the movement of the linear actuator in the activated state while the replaceable cartridge provides ink to the printing system.

* * * * *